US012710197B2

(12) United States Patent
Baldwin, Jr. et al.

(10) Patent No.: US 12,710,197 B2
(45) Date of Patent: Aug. 18, 2026

(54) CONDENSATION PANS, HEAT PUMP SYSTEMS, AND METHODS OF FILTERING CONDENSATE

(71) Applicant: Midea Group Co., Ltd., Beijiao (CN)

(72) Inventors: Donald William Baldwin, Jr., Louisville, KY (US); Joel M. Gray, Prospect, KY (US)

(73) Assignee: Midea Group Co., Ltd., Foshan (CN)

( * ) Notice: Subject to any disclaimer, the term of this patent is extended or adjusted under 35 U.S.C. 154(b) by 329 days.

(21) Appl. No.: 18/347,934

(22) Filed: Jul. 6, 2023

(65) Prior Publication Data

US 2025/0012480 A1 Jan. 9, 2025

(51) Int. Cl.
*F24F 13/22* (2006.01)

(52) U.S. Cl.
CPC ..... *F24F 13/222* (2013.01); *F24F 2013/227* (2013.01); *F24F 2013/228* (2013.01)

(58) Field of Classification Search
None
See application file for complete search history.

(56) References Cited

U.S. PATENT DOCUMENTS

| | | | | |
|---|---|---|---|---|
| 6,290,143 | B1 * | 9/2001 | Vincent | E01B 1/008 238/2 |
| 7,886,557 | B2 | 2/2011 | Anderson et al. | |
| 2010/0307910 | A1 | 12/2010 | Engelhart | |
| 2018/0202685 | A1 | 7/2018 | Pignolo | |
| 2022/0146145 | A1 * | 5/2022 | Hatcher | F24F 13/222 |

FOREIGN PATENT DOCUMENTS

| | | | |
|---|---|---|---|
| DE | 102015212649 | A1 | 1/2017 |
| WO | 2022058753 | A1 | 3/2022 |

* cited by examiner

*Primary Examiner* — Elizabeth J Martin
(74) *Attorney, Agent, or Firm* — Dinsmore & Shohl LLP

(57) ABSTRACT

A condensation pan includes a proximal end, a distal end, and a body extending from the proximal end to the distal end, a plurality of dam members formed across the body, and a plurality of skimming members formed adjacent each of the plurality of dam members. A condensate passively flows from the distal end of the body to the proximal end of the body, such that the condensate flows past each of the plurality of dam members and each of the plurality of skimming members.

19 Claims, 4 Drawing Sheets

CONDENSATION PANS, HEAT PUMP SYSTEMS, AND METHODS OF FILTERING CONDENSATE

TECHNICAL FIELD

The present disclosure generally relates to heat pump systems, and more particularly, to condensation pans for heat pump systems that remove contaminant from condensate

BACKGROUND

Heat pump systems are widely used for their ability to deliver efficient cooling and heating. However, the collection of condensate during operation poses challenges, particularly in environments where dripping condensate may cause hazards or damage to people and/or property. Traditional approaches to condensate management often involve transporting condensate formed during a heating or cooling cycle to various downstream processes (e.g., humidification systems, misting nozzles, etc.), but these approaches often result in blockages throughout the system due to contamination in the condensate. Accordingly, a need exists for a condensate management approach that allows for condensate to be transferred to downstream processes while alleviating the risk of blockages.

SUMMARY

In the embodiments described herein, a condensation pan is disclosed. The condensation pan includes a proximal end, a distal end, and a body extending from the proximal end to the distal end, a plurality of dam members formed across the body, and a plurality of skimming members formed adjacent each of the plurality of dam members. A condensate passively flows from the distal end of the body to the proximal end of the body, such that the condensate flows past each of the plurality of dam members and each of the plurality of skimming members.

In another embodiment, a heat pump system is disclosed. The heat pump system includes a first heat exchanger, a second heat exchanger that forms a condensate positioned opposite the first heat exchanger, a compressor positioned between the first heat exchanger and the second heat exchanger, and a condensation pan positioned downstream of the second heat exchanger. The heat pump system further includes a condensation pan positioned downstream of the second heat exchanger, with the condensation pan being configured to collect condensation formed by the second heat exchanger. The condensation pan further includes a proximal end, a distal end, and a body extending from the proximal end to the distal end, a plurality of dam members formed across the body, and a plurality of skimming members formed adjacent each of the plurality of dam members. The heat pump system further includes a filtration system fluidly coupled to the condensation pan to receive the condensate collected by the condensation pan, and a distribution system fluidly coupled to the filtration system. The condensate passively flows from the distal end of the body to the proximal end of the body, such that the condensate flows past each of the plurality of dam members and each of the plurality of skimming members.

In other embodiments still, a method of filtering contaminants from a condensate is disclosed. The method may involve initiating a heating or cooling cycle of a heat pump system including a first heat exchanger, a second heat exchanger, a condensation pan positioned downstream of the second heat exchanger, a distribution system, and a filtration system positioned between the condensation pan and the distribution system; collecting condensate formed by the second heat exchanger in the condensation pan; passively passing the condensate over each of a plurality of dams and each of a plurality of skimming members formed on the condensation pan; transferring the condensate collected by the condensation pan to a filtration system; and transferring a filtered condensate to the distribution system of the heat pump system.

These and other advantages and features, which characterize the invention, are set forth in the claims annexed hereto and forming a further part hereof. However, for a better understanding of the invention, and of the advantages and objectives attained through its use, reference should be made to the figures, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

The embodiments described herein are directed to condensation pans, heat pump system, and methods of filtering condensate. More specifically, the present disclosure relates to condensation pans for heat pump systems that are configured to passively remove contaminants from condensate formed and collected during heating and/or cooling processes. In these embodiments, the condensation pan may include a distal end, a proximal end, and a body extending from the distal end to the proximal end. A plurality of dam members and a plurality of skimming members may be positioned along the body of the condensation pan. As condensate traverses the condensation pan, the contaminants may interact with each of the plurality of dam members and each of the plurality of skimming members, such that the contaminants may be removed from the condensate. By passively filtering the condensate, contaminants may be removed from the condensate via the separation plate before the condensate is transferred to other downstream components of the heat pump system.

As described herein, condensate forms on heat exchangers (e.g., evaporation/condenser coils) of heat pump systems during operation. For example, during a heating cycle, the outdoor heat exchanger acts as an evaporation coil. Accordingly, when humidity levels are sufficiently high, condensation may form and cascade down the outdoor heat exchanger.

In certain heat pump system applications, allowing the condensate to drip out of the system is undesirable for a number of reasons. For example, condensate can present a variety of hazards for high-rise multi-family apartments and/or condos in areas with the potential for freezing temperatures. In these temperatures, condensate formed by a heat pump system may freeze to form dangerous icicles that may cause injury to persons and/or property.

To address this issue, condensate needs to be handled in a more effective manner. In the heating cycle, some of the condensate can be used to humidify the indoor space, which may leave the remainder of the condensate to be returned to the outdoor environment. However, transporting the condensate to various downstream processes creates the opportunity for blockages that stem from the contamination of the condensate formed in these systems. Accordingly, a need exists for a heat pump system that may allow for the removal of the contaminants from the condensate in order to alleviate and/or eliminate issues with clogging that often occur in these downstream components (e.g., humidification systems, misting nozzles, etc.).

Embodiments of condensation pans, heat pump systems, and methods of filtering condensate will now be described in additional detail herein. The following will now described these plates, systems, and methods with reference to the drawings and where like numbers refer to like structures.

Figure 1:
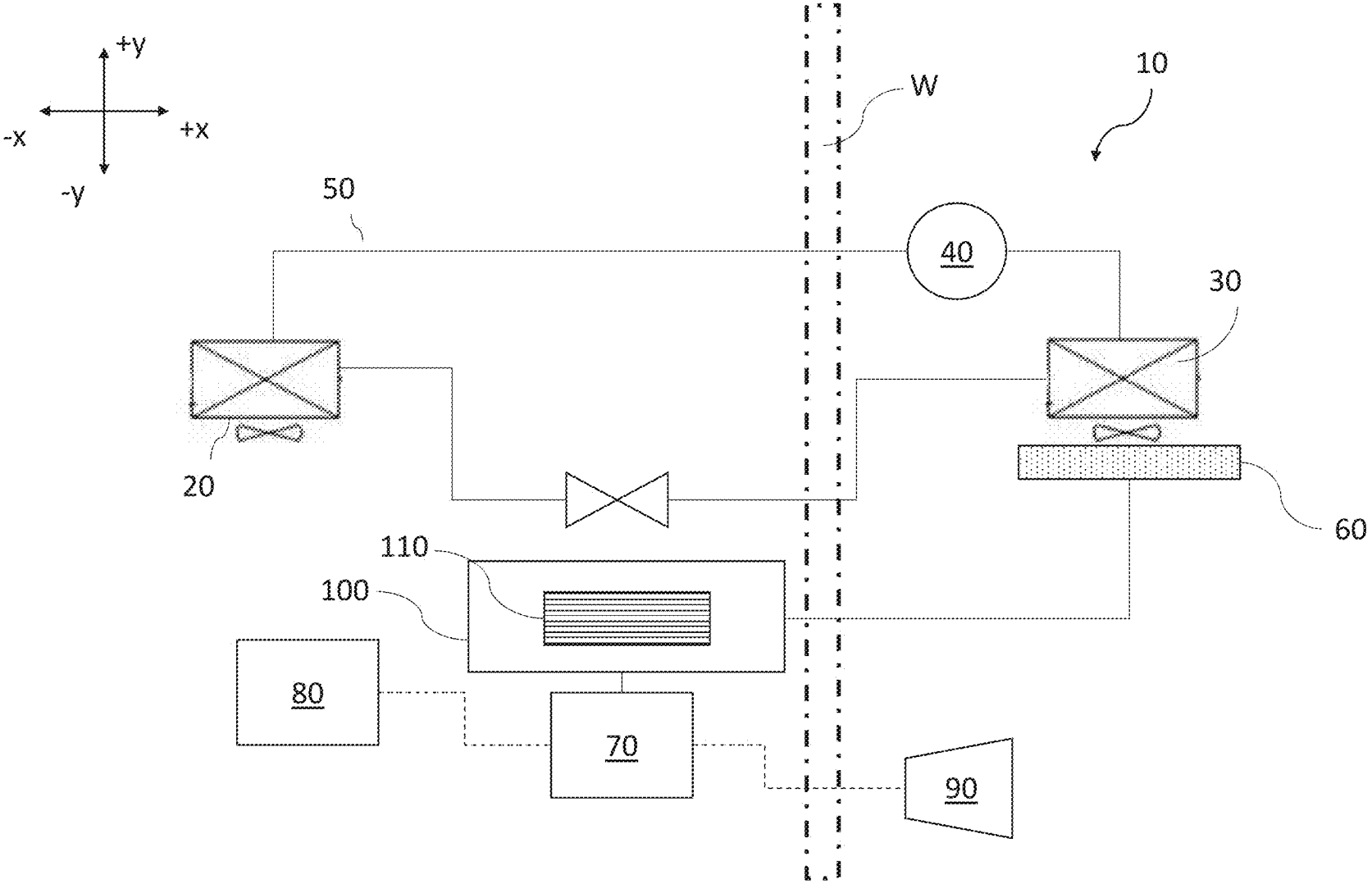
FIG. 1 is a schematic view of a heat pump system, according to one or more embodiments shown and described herein.

Referring now to FIG. 1, a schematic view of a heat pump system 10, such as a window heat pump system, is depicted. The heat pump system 10 may include a first heat exchanger 20, a second heat exchanger 30, a compressor 40, and a plurality of refrigerant lines 50 that facilitate the heat transfer process. Although the heat pump system 10 of FIG. 1 is depicted as being a window heat pump system, it should be appreciated that the heat pump system 10 may be any type of heat pump or air conditioning unit capable of providing cooling and heating to indoor spaces without departing from the scope of the present disclosure.

As further depicted in FIG. 1, the heat pump system 10 may be a compact and/or self-contained device that is configured to be installed within a window W or other similar wall opening, thereby allowing for integration of the heat pump system 10 into various environments. Accordingly, it should be appreciated that once the heat pump system 10 is installed, various components of the heat pump system 10 may be positioned on either an "indoor" side of the heat pump system 10 or an "outdoor" side of the heat pump system 10, as will be described in additional detail herein.

For example, in the embodiments described herein, the first heat exchanger 20 and the second heat exchanger 30 may be positioned on opposite sides of the heat pump system 10. As depicted in FIG. 1, the first heat exchanger 20 may be positioned on the indoor side of the heat pump system 10 (e.g., in the −x-direction relative the window W as depicted in the coordinate axis of FIG. 1), while the second heat exchanger 30 may be positioned on the outdoor side of the heat pump system 10 (e.g., in the +x-direction relative the window W as depicted in the coordinate axis of FIG. 1).

Referring still to FIG. 1, in these embodiments, the first heat exchanger 20 may be an evaporator coil, while the second heat changer 30 may be a condenser coil. In these embodiments, the evaporator coil may absorb heat from indoor air during a cooling cycle of the heat pump system 10 and release heat during heating cycle of the heat pump system 10. For example, the evaporator coil may include a plurality of refrigerant-filled tubes and/or fins to aid in maximizing heat transfer during the cooling and heat cycles of the heat pump system 10, respectively.

As indoor air passes over the evaporator coil, the refrigerant within the evaporator coil absorbs heat from the indoor air, causing the indoor air to cool down. The absorbed heat from the indoor air is then passed via the refrigerant through the plurality of refrigerant lines 50 to other components of the heat pump system 10. For example, the plurality of refrigerant lines 50 may pass the refrigerant and absorbed heat from the indoor air to the compressor 40, which may compress the refrigerant such that the temperature and pressure of the refrigerant increase. The pressurized refrigerant may then pass to the condenser coil (e.g., the second heat exchanger 30 located on the outdoor side of the heat pump system 10).

In the condenser coil, the pressurized refrigerant releases the absorbed heat from the indoor air into an external environment. The external environment (e.g., outdoor air, etc.) may be at a lower temperature than the refrigerant, which may cause the refrigerant to condense back into a liquid state. This process may be continued throughout the heat pump system 10 until the indoor air has reached a desired temperature.

In contrast, during the heating cycle, the heat pump system 10 may reverse its operation. That is, during the heating cycle, the first heat exchanger 20 may act as the condenser coil, while the second heat exchanger 30 may act as the evaporator coil. In these embodiments, the compressor 40 acts to increase the pressure and temperature of the refrigerant, thereby allowing the refrigerant to release heat into the indoor space.

Referring still to FIG. 1, the heat pump system 10 may further include a condensation pan 60, which may be positioned to collect condensate formed on the first and/or second heat exchanger 20, 30 during operation of the heat pump system. For example, as depicted in FIG. 1, the condensation pan 60 may be located beneath the second heat exchanger 30 (e.g., the outdoor heat exchanger). In these embodiments, when humidity levels are high, condensation may form and cascade down the second heat exchanger 30.

The condensate formed on the second heat exchanger 30 may accumulate within the condensation pan 60. In these embodiments, the condensation pan 60 may include a plurality of drainage mechanisms that may aid in containing and managing the condensate collected in the condensation pan 60. In some embodiments, the condensation pan 60 may include a sloped and/or angled surface that may aid in facilitating condensate towards the drainage mechanisms.

Referring still to FIG. 1, the heat pump system 10 may further include a distribution system 70 that may be configured to transport condensate collected in the condensation pan 60 to downstream components of the heat pump system 10, such as a humidification system or a misting nozzle. For example, in some embodiments, the distribution system 70 may include a distribution pump powered by an impeller. In these embodiments, the rotation of the impeller may create a centrifugal force that draws condensate from the condensation pan 60 and into the distribution system 70.

As further depicted in FIG. 1, the distribution system 70 may deliver the condensate to a number of additional components of the heat pump system 10, such as a humidification system 80 or a misting nozzle 90. For example, in embodiments in which the condensate is directed towards the humidification system 80, the humidification system 80 may utilize the condensate to add moisture to the indoor air, thereby increasing humidity levels within the indoor environment. In embodiments in which the condensate is directed towards the misting nozzle 90, the misting nozzle 90 may transform the condensate into fine droplets which may be released into the external (e.g., outdoor) environment. In these embodiments, dispersing the condensate (either via the humidification system 80 or the misting nozzle 90) may aid in minimizing the risk of water accumulation within the heat pump system 10. Furthermore, although the schematic of FIG. 1 depicts the heat pump system 10 as having either the humidification system 80 or the misting nozzle 90, it should be appreciated that, in some embodiments, the heat pump system 10 may include both components. For example, the heat pump system 10 may further include control mechanisms that enable a portion of the condensate to be transmitted to the humidification system 80 while the remainder of the condensate is transmitted to the misting nozzle 90.

Referring still to FIG. 1, the condensation pan 60 may be configured for removing contaminants from the condensate prior to transferring the condensate to the distribution system 70. For example, condensate that forms on the second heat exchanger 30 (e.g., the outdoor heat exchanger) may contain various contaminants such as dust, dirt, debris, and other similar microbial particles. When these contaminants remain in the condensate that is transported to the distribution system 70, the contaminants may cause clogging and other similar issues within the distribution system 70, the humidification system 80, and/or misting nozzle 90. In these embodiments, the blocking and/or clogging of the distribution system 70, humidification system 80, and/or misting nozzle 90 may result in failure of the heat pump system 10, which may in turn necessitate costly and timely repairs. Removal of contaminants from the condensation pan 60 will be described in additional herein with reference to FIGS. 2 and 3.

Referring still to FIG. 1, in some embodiments, the heat pump system 10 may further include a filtration system 100, which may be configured for removing any remaining contaminants from the condensate collected in the condensation pan 60 prior to the condensate being transferred to the distribution system 70.

Accordingly, the filtration system 100 depicted in FIG. 1 may be disposed between the condensation pan 60 and the distribution system 70 in order to remove remaining contaminants from the condensate before the condensate is received by the distribution system 70. In these embodiments, the filtration system 100 may be disposed downstream (e.g., in the −y-direction as depicted in the coordinate axis of FIG. 2) of the condensation pan 60. More particularly, the filtration system 100 may be fluidly coupled to the condensation pan 60 via the drainage mechanisms of the condensation pan 60, such that condensate collected in the condensation pan 60 drains into the filtration system 100.

Figure 2:
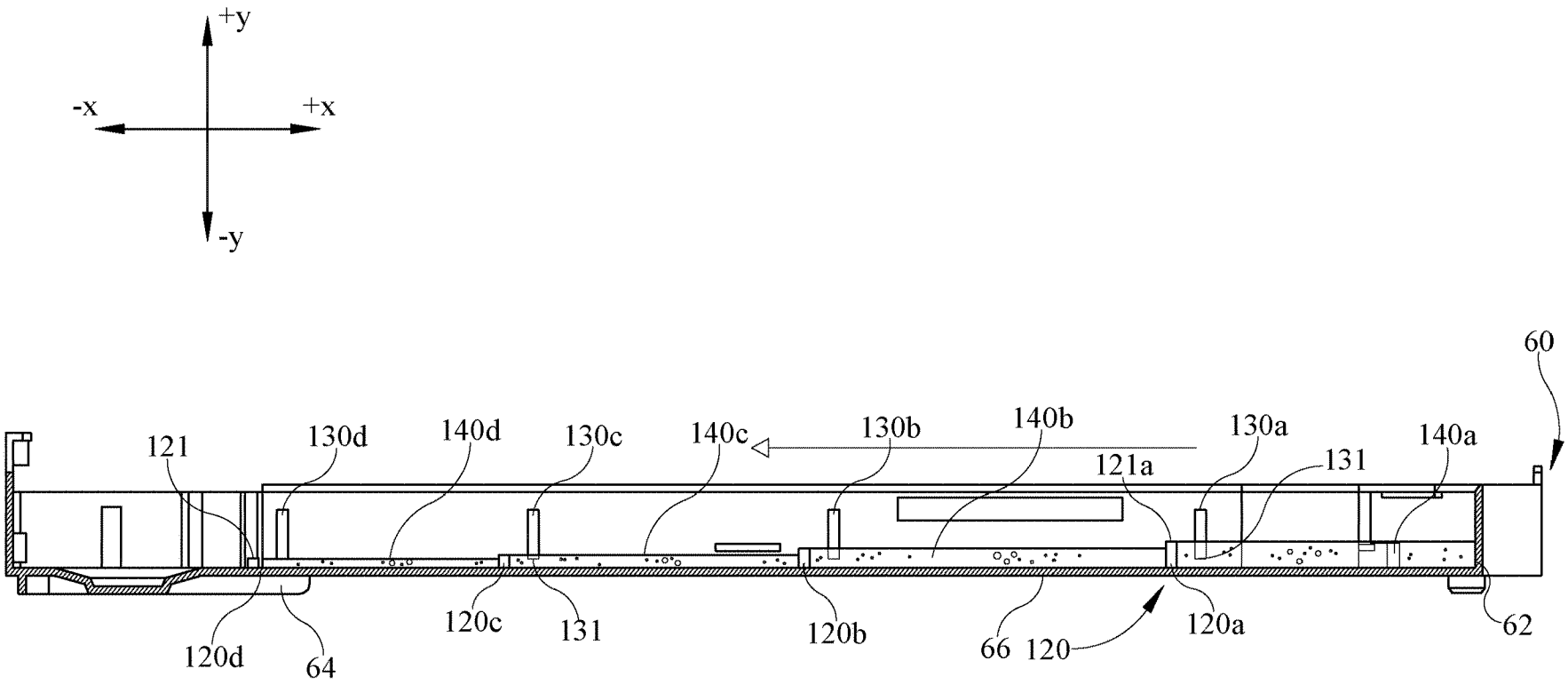
FIG. 2 is a schematic view of an embodiment of a condensation pan of the heat pump system of FIG. 1, according to one or more embodiments shown and described herein.
Figure 3:
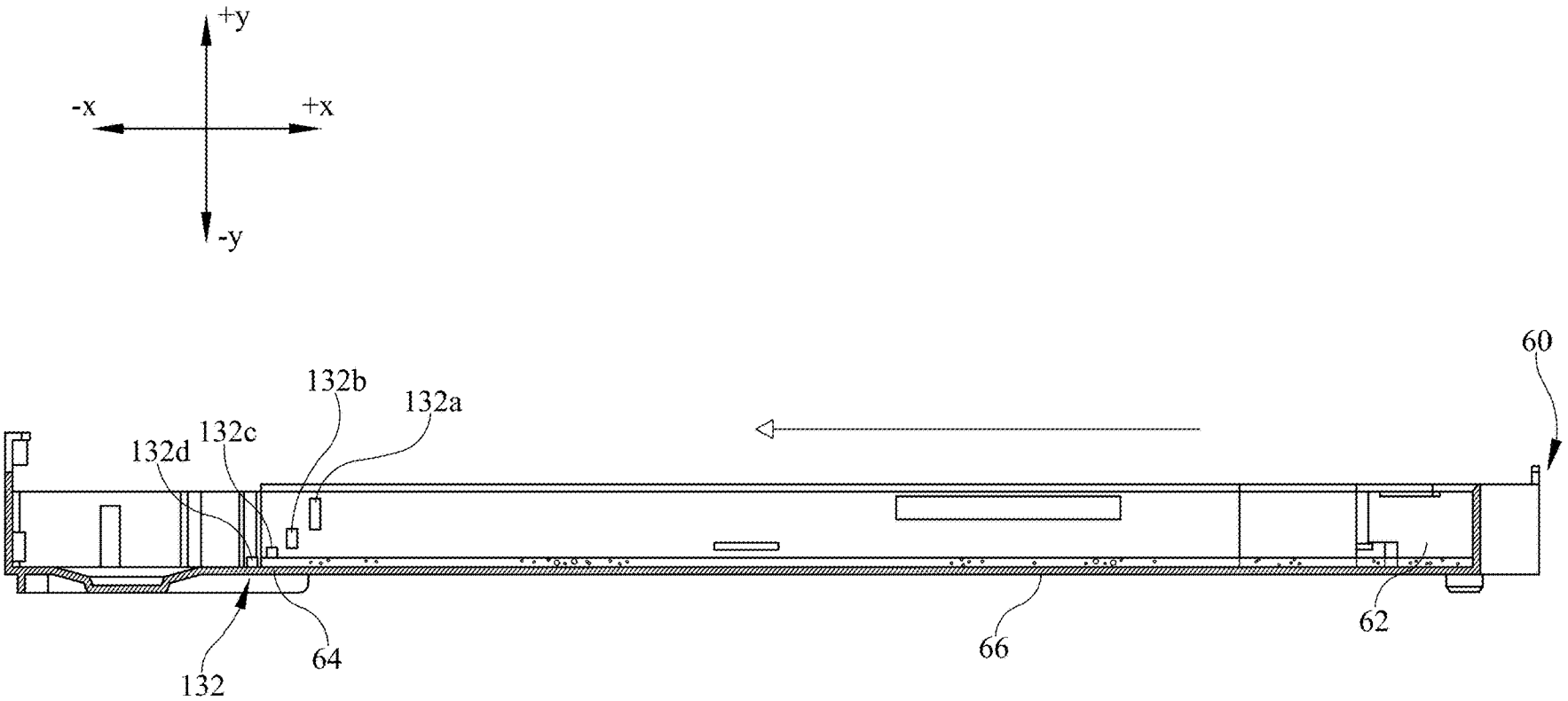
FIG. 3 is a schematic view of another embodiment of a condensation pan of the heat exchanger of FIG. 1, according to one or more embodiments shown and described herein.

Referring now to FIGS. 1-3, the condensation pan 60 may be configured to separate contaminants from the condensate as the condensate flows across (e.g., in the +/−x-direction as depicted in the coordinate axis of FIG. 2) the condensation pan 60. In these embodiments, the condensation pan 60 may include a distal end 62, a proximal end 64, and a body 66 that extends between the distal end 62 and the proximal end 64 in a longitudinal direction (e.g., in the +/−x-direction as depicted in the coordinate axis of FIG. 2).

The distal end 62 of the condensation pan 60 may be aligned with a first end of the second heat exchanger 30, while the proximal end 64 may be aligned with a second end of the second heat exchanger 30, such that the body 66 extends along an entire length of the condensation pan 60 and is able to capture any condensate that forms and drips from the second heat exchanger 30. As further depicted in FIG. 2, the proximal end 64 of the condensation pan 60 may be fluidly coupled to the filtration system 100, which may be configured to remove any remaining contaminants from the condensate, as will be described in additional detail herein.

As further depicted in FIGS. 2 and 3, the condensation pan 60 may further include a plurality of dam members 120 and a plurality of skimming members 130 positioned adjacent each of the plurality of dam members 120, which may be intermittently spaced across a length of the body 66 from the distal end 62 to the proximal end 64. In these embodiments, the plurality of dam members 120 and the plurality of skimming members 130 may define a plurality of contaminant ponds 140, which may accumulate contaminants to be removed from the condensate as the condensate flows from the distal end 62 to the proximal end 64 of the condensation pan 60.

In these embodiments, the plurality of dam members 120 may be configured to remove larger, heavier contaminants from the condensate. For example, as condensate collects in the condensation pan 60, each of the plurality of dam members 120 may cause the condensate to collect into one of the plurality of contaminant ponds 140. Prior to flowing past each of the plurality of dam members 120, the condensate in each of the plurality of contaminant ponds 140 must pool to a level that meets and/or exceeds the level of each of the plurality of dam members 120. As the condensate pools in each of the plurality of contaminant ponds 140, larger, heavier contaminants in the condensate may settle against each of the plurality of dam members 120 and/or on the condensation pan 60, such that the contaminants are removed from the condensate which flows past each of the plurality of dam members 120.

Referring still to FIGS. 2 and 3, as the plurality of dam members 120 filter larger, heavier condensate from each of the plurality of contaminant ponds 140, the plurality of skimming members 130 may be configured to remove comparatively lighter, smaller contaminants from the condensate. In these embodiments, each of the plurality of skimming members 130 may include a bottom surface 131 that extends below (e.g., in the −y-direction as depicted in FIGS. 2 and 3) a top surface 121 of each of the plurality of dam members 120. Accordingly, this configuration may force the condensate to travel under each of the plurality of skimming members 130 as the condensate flows from the distal end 62 of the condensation pan 60 to the proximal end 64 of the condensation pan 60. As the condensate flows past (e.g., under) each of the plurality of skimming members 130, the comparatively lighter, smaller contaminants may be removed from the condensate.

An exemplary operation sequence of the condensation pan 60 will now be described with reference to FIG. 2. In the embodiment depicted in FIG. 2, the plurality of dam members 120 may include a first dam member 120*a*, a second dam member 120*b*, a third dam member 120*c*, and a fourth dam member 120*d*. Similarly the plurality of skimming members 130 may include a first skimming member 130*a*, a second skimming member 130*b*, a third skimming member 130*c*, and a fourth skimming member 130*d*.

As further depicted in FIG. 2, a plurality of contaminant ponds 140 may be defined between each of the plurality of dam members 120 and the plurality of skimming members 130. For example, a first contaminant pool 140*a* may be defined between the distal end 62 of the condensation pan 60 and the first dam member 120*a* and the first skimming member 130*a*. A second contaminant pool 140*b* may be defined between the first dam member 120*a* and first skimming member 130*a* and the second dam member 120*b* and second skimming member 130*b*. A third contaminant pool 140*c* may be defined between the second dam member 120*b* and the second skimming member 130*b* and the third dam member 120*c* and the third skimming member 130*c*, and a fourth contaminant pool 140*d* may be defined between the third dam member 120*c* and the third skimming member 130*c* and the fourth dam member 120*d* and the fourth skimming member 130*d*.

In operation, as condensate collects in the condensation pan 60, each of the plurality of contaminant pools 140 may fill with condensate. For example, the first contaminant pool 140*a* may fill with condensate. In these embodiments, as the first contaminant pool 140*a* is filled, the first dam member 120*a* may cause larger, heavier contaminants to settle against the first dam member 120*a* and/or in the bottom of the first contaminant pool 140*a*. As the first contaminant pool 140*a* fills, the condensate may also interact with the first skimming member 130*a*, which may remove comparatively lighter, smaller contaminants from a top surface of the first contaminant pool 140*a*.

Once the first contaminant pool 140*a* fills to a level that meets and or exceeds the top surface 121*a* of the first dam member 120*a*, the condensate from the first contaminant pool 140*a* may to flow past the first dam member 120*a* and begin to fill the second contaminant pool 140*b*. The filtering process that occurs in the first contaminant pool 140*a* via the first dam member 120*a* and the first skimming member 130*a* may be repeated in each subsequent contaminant pool (e.g., the second, third, and fourth contaminant pools 140*a-c*, as depicted in FIG. 2) until the condensate reaches the proximal end 64 of the condensation pan 60.

Although the condensation pan 60 depicted in FIG. 2 includes four dam members 120 and four skimming members 130, it should be appreciated that the condensation pan 60 may include any number of dam members and any number of skimming members without departing from the present disclosure. Furthermore, it should be noted that the number of skimming members and the number of dam members may, in some embodiments, be unequal. For example, the condensation pan 60 may include three dam members and only two skimming members, or any other similar combination.

Additionally, it should be noted that plurality of dam members 120 and the plurality of skimming members 130 may be equally spaced across the length of the condensation pan 60, as is depicted in FIG. 2. However, in other embodiments, the dam members 120 and the plurality of skimming members 130 may be variably spaced across the condensation pan 60 without departing from the scope of the present disclosure. Furthermore, it should be understood that, in each of the embodiments described herein, the number of the plurality of contaminant ponds 140 may be determined based on the number of the plurality of dam members 120 and each of the plurality of skimming members 130.

Referring still to FIG. 2, it should be appreciated that each of the plurality of dam members 120 may have an equal height (e.g., in the +/−y-direction from the condensation pan 60 to the top surface 121 of each of the plurality of dam members 120 as depicted in the coordinate axis of FIG. 2). However, in other embodiments, each of the plurality of dam members 120 may have different heights, such that each of the plurality of dam members 120 are arranged in a staircase configuration (e.g., from the distal end 62 of the condensation pan 60 to the proximal end 64 of the condensation pan 60). For example, the first dam member 120*a* may include a first height, the second dam member 120*b* may include a second height less than the first height, the third dam member 120*c* may include a third height less than the second height, and the fourth dam member 120*d* may include a fourth height less than the third height. It should be appreciated that these embodiments are illustrative in nature, and each of the plurality of dam members 120 may include any height without departing from the present disclosure.

Similarly, it should be understood that each of the skimming members 130 may have an equal height. However, in other embodiments, each of the plurality of skimming members 130 may have different heights, as may be necessitated by the height of each respective dam member of the plurality of dam members 120. For example, each of the plurality of skimming members 130 may have a height that allows for the skimming member to interact with the condensate collected in each of the respective contaminant ponds 140. It should be appreciated that these embodiments are illustrative in nature, and each of the plurality of skimming members 130 may include any height without departing from the present disclosure.

Referring now to FIG. 3, it should be appreciated that, in some embodiments, the condensation pan 60 may further include a second plurality of skimming members 132 that may be positioned at the proximal end 64 of the condensation pan 60. In these embodiments, the second plurality of skimming members 130 may be arranged in a cascading manner, such that, in the event each of the plurality of contaminant ponds 140 fill with condensate and/or contaminant, the second plurality of skimming members 132 may act as a second plurality of dams. For example, as depicted in FIG. 3, the second plurality of skimming members 132 may include a fifth skimming member 132*a*, a sixth skimming member 132*b*, a seventh skimming member 132*c*, and an eighth skimming member 132*d*. In the event the contaminant ponds 140 become filled with contaminant, each of the second plurality of skimming members 132 may act as dams for the purposes of filtering larger, heavier contaminants from the condensate before the condensate reaches the proximal end 64 of the condensation pan 60. For example, in the embodiment depicted in FIG. 3, the eighth skimming member 132*d* may function as a first dam member while the seventh skimming member 132*c* may function as the first skimming member. In the event contaminant fills the area behind the eighth skimming member 132*d*, the seventh skimming member 132*c* may then act as a second dam member, while the sixth skimming member 132*b* may act as a second skimming member. It should be appreciated that the function of each of the second plurality of skimming members 132 may be determined based on the volume of contaminant and the number of the second plurality of skimming members 132 positioned at the proximal end 64 of the condensation pan 60. Accordingly, the second plurality of skimming members 132 may increase the contaminant capacity of the condensation pan 60.

Referring again to FIGS. 1-3, once the contaminant is removed from the condensate in the condensation pan 60, the condensate may be transferred to the filtration system 100 for additional filtering. In these embodiments, a pump may be positioned between the filtration system 100 and the condensation pan 60 and may be configured to transfer the condensate from the condensation pan 60 to the filtration system 100. In some embodiments, the pump may be configured to intake condensate from an area below a top surface of the condensate, which may help ensure that smaller, lighter contaminants remaining on the top surface of the condensate are not transferred to the filtration system 100. Additionally, the pump may be configured to intake condensate at a level above the bottom of the sump and below the top surface of the condensate, thus pulling water from the middle of the sump area, such that larger, heavier contaminants are not transferred to the filtration system 100.

In these embodiments, the filtration system 100 may further include a separation plate 110 that may be configured for removing small and/or fine contaminants (e.g., dust, debris, microbial particles, lint, pollen, etc.) from the condensate. For example, the separation plate 110 may include a plurality of walls that each include a plurality of contaminant traps.

The contaminant traps of each of the plurality of walls may take a variety of forms without departing from the scope of the present disclosure. For example, in some embodiments, the plurality of contaminant traps may include micro-sized perforations or pores that allow condensate to pass through while trapping larger contaminants. In these embodiments, the dimensions and/or geometry of the perforations and/or pores may be configured based on the contaminants to be captured by the contaminant traps. In other embodiments, the plurality of contaminant traps may include mesh screens, such as fine mesh screens made of steel, nylon, or any other similar material. In these embodiments, the mesh screen may be capable of capturing debris and other particles that have size larger than the size of the openings of the mesh screen, while allowing condensate to pass through the mesh screen.

Further still, in some embodiments, the contaminant traps may include specialized filter media, such as carbon or other synthetic fibers. In these embodiments, the contaminant traps may utilize fibers that have particular adsorptive properties that may allow the contaminant traps to attract and/or capture contaminants including odors, organic compounds, and/or chemicals present in the condensate.

In other embodiments, the contaminant traps may include baffle chambers, or other similar mechanisms capable of altering the flow direction of the condensate as the condensate traverses the separation plate 110. For example, altering the flow of the condensate across the separation plate 110 may cause larger and/or heavier contaminants to settle against the plurality of walls of the separation plate 110 as the condensate flows.

In other embodiments still, the contaminant traps may include magnetic traps. For example, the contaminant traps may include magnetic traps that may be configured for removing metallic contaminants and/or particles from the condensate. In these embodiments, the contaminant traps may magnetically attract and retain ferrous contaminants as the condensate passes through the plurality of contaminant traps.

It should be appreciated that the foregoing is presented for illustrative purposes only, and the contaminant traps may include any type of trap capable of separating contaminants from the condensate that flows across the separation plate 110 without departing from the scope of the present disclosure.

Referring again to FIGS. 1-3, once the condensate has passed through the filtration system 100 (e.g., through the condensation pan 60 and the separation plate 110), the filtered condensate may be passed to the distribution system 70. As should be appreciated in view of the foregoing, the filtered condensate may alleviate the issues with clogging of the distribution system 70, humidification system 80, and/or misting nozzle 90 that are generally caused by the filtered contaminants.

Figure 4:
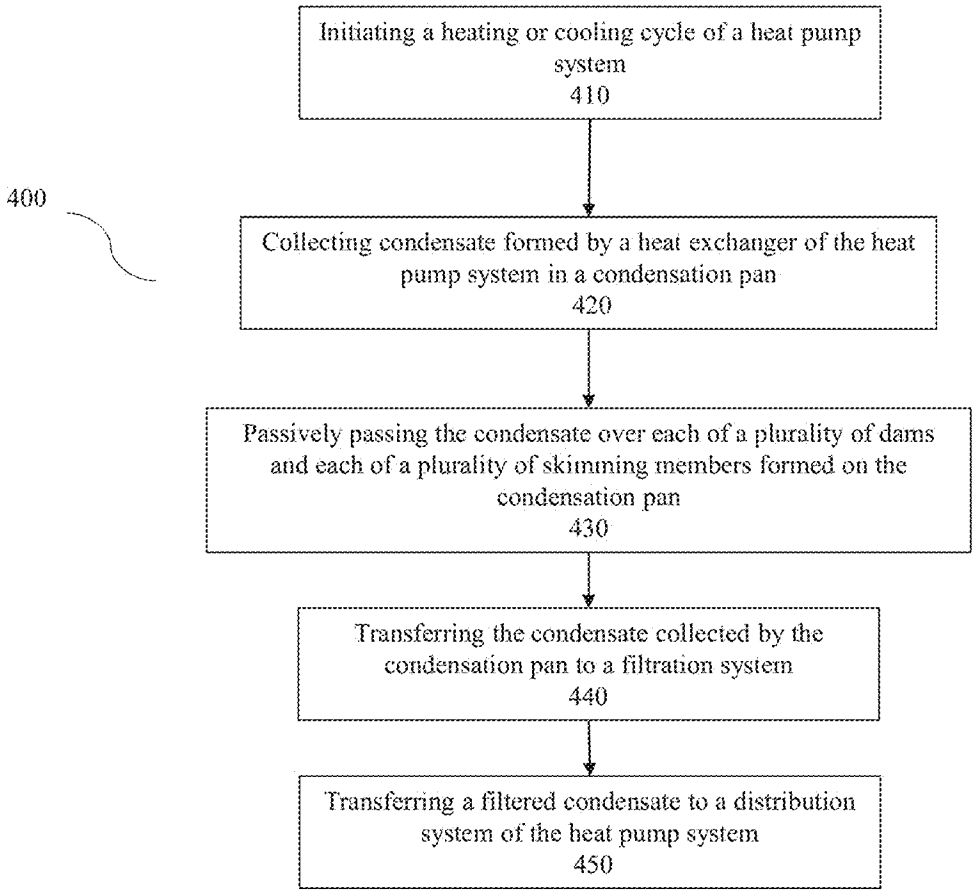
FIG. 4 is an illustrative flow diagram of a method of cleaning condensate using the heat pump system of FIG. 1, according to one or more embodiments shown and described herein.

Turning now to FIG. 4, an illustrative flow diagram of a method 400 of filtering a condensate is depicted. As shown in FIG. 4, the method 400 may first involve initiating a heating or cooling cycle of a heat pump system including a first heat exchanger, a second heat exchanger, a condensation pan positioned downstream the first and/or second heat exchanger, a distribution system, and a filtration system positioned between the condensation pan and the distribution system, as shown at block 410.

With the heating or cooling cycle initiated, the method may advance to block 420, which may involve collecting condensate formed by the first or second heat exchanger in a condensation pan. Once the condensate is collected, the method may advance to block 430, which may involve passing the condensate through the condensation pan, such that the condensate flows past each of a plurality of dam members and each of a plurality of skimming members formed on the condensation pan. In these embodiments, contaminants within the condensate may be filtered by the plurality of dam members and the plurality of skimming members as the condensate traverses the condensation pan.

Once the condensate has traversed the condensation pan and the contaminants have been removed, the method may move to block 440, which may involve transferring the condensate to a filtration system. Once the condensate has passed the filtration system, the method may advance to block 450, which may involve transferring the filtered condensate from the filtration system to the distribution system. In some embodiments, the method may further involve transferring the condensate from the filtration system to a separation plate within the filtration system to remove any remaining contaminants from the condensate prior to transferring the condensate to the distribution system. Once the distribution system receives the condensate, the distribution system may utilize the condensate to humidify an inside room in which the heat pump system is positioned, or may exhaust the condensate via a misting nozzle to an external (e.g., outside) environment.

As should be appreciated in view of the foregoing, a condensation pan and a heat pump system are described herein. The condensation pan may include a distal end, a proximal end, and a body extending from the distal end to the proximal end. A plurality of dam members and a plurality of skimming members may be positioned along the body of the condensation pan. As condensate traverses the condensation pan, the contaminants may interact with each of the plurality of dam members and each of the plurality of skimming members, such that the contaminants may be removed from the condensate. By passively filtering the condensate, contaminants may be removed from the condensate via the separation plate before the condensate is transferred to other downstream components of the heat pump system. Accordingly, removal of the contaminants may alleviate and/or eliminate issues with clogging that often occur in these downstream components (e.g., humidification systems, misting nozzles, etc.).

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A condensation pan comprising:

a proximal end, a distal end, and a body extending from the proximal end to the distal end;

a plurality of dam members formed across the body, each dam member comprising a top surface; and a plurality of skimming members formed adjacent each of the plurality of dam members, each skimming member comprising a bottom surface;

wherein the bottom surface of the skimming member is lower than the top surface of the dam member such that when a condensate passively flows from the distal end of the body to the proximal end of the body, that the condensate flows past each of the top surface of the plurality of dam members and each of the bottom surface of the plurality of skimming members.

2. The condensation pan of claim 1, wherein each of the plurality of dam members is of the same height.

3. The condensation pan of claim 1, wherein each of the plurality of dam members is of a different height, such that the plurality of dam members are arranged in a staircase configuration from the distal end of the condensation pan to the proximal end of the condensation pan.

4. The condensation pan of claim 1, wherein each of the plurality of skimming members is of the same height.

5. The condensation pan of claim 1, wherein each of the plurality of skimming members are of a different height.

6. The condensation pan of claim 1, further comprising a second plurality of skimming members positioned at the proximal end of the condensation pan.

7. The condensation pan of claim 1, wherein a plurality of contaminant pools are defined between each of the plurality of dam members and each of the plurality of skimming members.

8. A system comprising:

a condensation pan comprising:

a proximal end, a distal end, and a body extending from the proximal end to the distal end;

a plurality of dam members formed across the body, each dam member comprising a top surface;

a plurality of skimming members formed adjacent each of the plurality of dam members, each skimming member comprising a bottom surface;

wherein the bottom surface of the skimming member is lower than the top surface of the dam member such that when the condensate passively flows from the distal end of the body to the proximal end of the body, the condensate flows past each of the top surface of the plurality of dam members and each of the bottom surface of the plurality of skimming members;

a filtration system fluidly coupled to the condensation pan to receive the condensate collected by the condensation pan; and a distribution system fluidly coupled to the filtration system.

9. The system of claim 8, wherein the plurality of dam members and the plurality of skimming members are arranged such that a bottom surface of each of the plurality of skimming members extends below a top surface of each of the plurality of dam members.

10. The system of claim 8, wherein each of the plurality of dam members is of the same height.

11. The system of claim 8, wherein each of the plurality of dam members is of a different height, such that the plurality of dam members are arranged in a staircase configuration from the distal end of the condensation pan to the proximal end of the condensation pan.

12. The system of claim 8, wherein each of the plurality of skimming members is of the same height.

13. The system of claim 8, wherein each of the plurality of skimming members are of a different height.

14. The system of claim 8, further comprising a second plurality of skimming members positioned at the proximal end of the condensation pan.

15. The system of claim 8, wherein a plurality of contaminant pools are defined between each of the plurality of dam members and each of the plurality of skimming members.

16. The system of claim 8, further comprising a separation plate positioned between the condensation pan and the distribution system.

17. A method of filtering contaminants from a condensate, the method comprising:

collecting condensate in a condensation pan, wherein the condensation pan comprises:

a proximal end, a distal end, and a body extending from the proximal end to the distal end;

a plurality of dam members formed across the body, each dam member comprising a top surface; and a plurality of skimming members formed adjacent each of the plurality of dam members, each skimming member comprising a bottom surface, wherein the bottom surface of the skimming member is lower than the top surface of the dam member;

allowing the condensate to passively pass from the distal end of the body to the proximal end of the body over each of the top surface of the plurality of dams and each of the bottom surface of the plurality of skimming members formed on the condensation pan; and transferring the condensate collected by the condensation pan to a filtration system; and transferring a filtered condensate to a distribution system.

18. The method of claim 17, further comprising transferring the condensate to a separation plate prior to transferring the filtered condensate to the distribution system.

19. The method of claim 17, further comprising transferring the filtered condensate from the distribution system to a humidification system or misting nozzle.

* * * * *